US012680702B2

(12) United States Patent
Choi et al.

(10) Patent No.: US 12,680,702 B2
(45) Date of Patent: Jul. 14, 2026

(54) AIR CONDITIONER

(71) Applicant: LG ELECTRONICS INC., Seoul (KR)

(72) Inventors: Jinwook Choi, Seoul (KR); Jeongtaek Park, Seoul (KR); Seokho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 706 days.

(21) Appl. No.: 17/802,258

(22) PCT Filed: Dec. 9, 2020

(86) PCT No.: PCT/KR2020/017971
§ 371 (c)(1),
(2) Date: Aug. 25, 2022

(87) PCT Pub. No.: WO2021/172714
PCT Pub. Date: Sep. 2, 2021

(65) Prior Publication Data

US 2023/0081066 A1 Mar. 16, 2023

(30) Foreign Application Priority Data

Feb. 25, 2020 (KR) ..... 10-2020-0023208

(51) Int. Cl.
*F24F 1/0011* (2019.01)
*F24F 1/0025* (2019.01)
*F24F 1/0057* (2019.01)

(52) U.S. Cl.
CPC ..... *F24F 1/0011* (2013.01); *F24F 1/0025* (2013.01); *F24F 1/0057* (2019.02)

(58) Field of Classification Search
CPC ..... F24F 1/0011; F24F 1/0057; F24F 1/0025; F24F 13/08; F24F 13/081
(Continued)

(56) References Cited

U.S. PATENT DOCUMENTS 5,918,666 A 7/1999 Chin
2005/0223732 A1 10/2005 Kim et al.
2018/0112888 A1* 4/2018 Na ..... F24F 1/0025

FOREIGN PATENT DOCUMENTS

CN 106907351 6/2017
CN 110701108 1/2020
(Continued)

OTHER PUBLICATIONS

Cho, Min, KR20090040792 Translation.pdf, "A ceiling mounted type air conditioner", Apr. 2009, pp. 1-7.*
(Continued)

*Primary Examiner* — Avinash A Savani
*Assistant Examiner* — Ryan L Faulkner
(74) *Attorney, Agent, or Firm* — KED & ASSOCIATES

(57) ABSTRACT

An air conditioner and an air guide for an air conditioner are provided, the air guide being configured to guide air to a cross-flow fan of the air conditioner. The air conditioner may include a case including a front panel and a rear panel, the front panel including an intake grill and an outlet, a cross-flow fan and a heat exchanger being disposed inside of the case. The rear panel may include an air guide. The air guide may include a first guide surface inclined toward the cross-flow fan, and a second guide surface positioned at a downstream side of the first guide surface. The first guide surface may include at least one distribution guide that distributes and guides air, and thus, the air having been equally distributed by means of the at least one distribution guide may be suctioned into the cross-flow fan so that vortex generation is prevented, thereby enabling noise to be reduced.

8 Claims, 9 Drawing Sheets

(58) Field of Classification Search
USPC ..... 454/233
See application file for complete search history.

(56) References Cited

FOREIGN PATENT DOCUMENTS

| | | | | |
|---|---|---|---|---|
| JP | 03-111694 | | 5/1991 | |
| JP | 03-274330 | | 12/1991 | |
| JP | 10-205797 | | 8/1998 | |
| JP | 2005-273601 | | 10/2005 | |
| JP | 2005-300133 | | 10/2005 | |
| JP | 2006-105444 | | 4/2006 | |
| JP | 2007-010240 | | 1/2007 | |
| JP | 5338842 | | 11/2013 | |
| JP | 2014-070519 | | 4/2014 | |
| JP | 2015-222058 | | 12/2015 | |
| JP | 2017-166457 | | 9/2017 | |
| KR | 10-1999-0080984 | | 11/1999 | |
| KR | 10-2005-0098990 | | 10/2005 | |
| KR | 10-0555422 | | 2/2006 | |
| KR | 10-2009-0040791 | | 4/2009 | |
| KR | 10-2009-0041809 | | 4/2009 | |
| KR | 20090040792 A | * | 4/2009 | ..... F24F 13/30 |
| KR | 10-2019-0086251 | | 7/2019 | |

OTHER PUBLICATIONS

Kong, Byung, KR20090041809 Translation.pdf, "A ceiling mounted type air conditioner", Apr. 2009, pp. 1-8.*
Korean Office Action issued in Application No. 10-2020-00232208 dated Aug. 21, 2024.
Japanese Office Action issued in Application No. 2022-550749 dated Dec. 12, 2023.
European Search Report issued in Application No. 20921180.4 dated Feb. 8, 2024.
International Search Report dated Mar. 26, 2021 issued in Application No. PCT/KR2020/017971.
Chinese Office Action issued in Application No. 202080097561.1 dated May 13, 2023.

* cited by examiner

AIR CONDITIONER

CROSS-REFERENCE TO RELATED APPLICATION(S)

This application is a U.S. National Stage Application under 35 U.S.C. § 371 of PCT Application No. PCT/KR2020/017971, filed Dec. 9, 2020, which claims priority to Korean Patent Application No. 10-2020-0023208, filed Feb. 25, 2020, whose entire disclosures are hereby incorporated by reference.

BACKGROUND

1. Field

An air guide for guiding air to a cross-flow fan of an air conditioner, and more particularly, to a distribution guide formed in the air guide is disclosed herein.

2. Background

An indoor unit of an air conditioner is placed indoors and changes a state of indoor air through processes, such as heating, cooling, dehumidification, humidification, and ventilation. The air conditioner generally includes of a blower fan inside a case for the above-described processes, and a blower fan suitable for the purpose and use is disposed in the case in consideration of a structure and flow direction of the air conditioner.

In this case, when a cross-flow fan is used as the blower fan, an air flow suctioned into the cross-flow fan is resisted due to parts, such as a control box, disposed inside of the case, which causes a non-uniform flow velocity distribution of the air suctioned into the cross-flow fan in a direction toward a rotary shaft. The non-uniform flow velocity distribution generates a vortex around the cross-flow fan, and the vortex causes friction with a suctioned air flow, thereby generating noise.

In order to solve this problem, Korean Patent Application No. 10-1999-0080984 discloses a method of noise reduction by adjusting a gap between a stabilizer and a cross-flow fan: however, it is difficult to apply the method equally to the air guide located on a suction side of the cross flow fan, and there is a problem in adaptability to flow angle change.

Korean Patent No. 10-0555422 discloses a method of reducing noise with a step formed on a slip stream of a cross-flow fan rear guide: however, it is not possible to suppress the occurrence of a vortex on a suction side of a cross-flow fan and there is no countermeasure against the above-described non-uniform flow velocity distribution.

DISCLOSURE

Technical Problem

An object is to make a flow velocity of air suctioned into the cross-flow fan uniform in a rotational axis direction, thereby suppressing noise generation due to flow friction.

Another object is to minimize flow loss due to friction with a case wall by concentrating suctioned air to a center of the cross-flow fan.

Another object is to reduce an increase in manufacturing costs by minimizing structural deformation for solving the above problems.

The objects are not limited to the objects mentioned above, and other objects not mentioned will be clearly understood by those skilled in the art from the following description.

Technical Solution

In order to achieve the above objects, an air conditioner according to an embodiment includes a case including a front panel and a rear panel, with an intake grille and an outlet formed in the front panel, the intake grille through which external air is introduced, and the outlet through which the introduced air is discharged; a cross-flow fan disposed in the case to suction air into the case; and a heat exchanger exchanging the introduced air with a refrigerant. An air guide located on a downstream side of the heat exchanger to guide the introduced air to the cross-flow fan is formed in the rear panel.

The air guide includes a first guide surface inclined toward the cross-flow fan, and a second guide surface located on a downstream side of the first guide surface and inclined rearward.

A distribution guide for uniformly distributing and guiding air, suctioned into the cross-flow fan, in a direction of a rotary shaft is formed in the first guide surface. The distribution guide may protrude from the first guide surface or may be depressed from the first guide surface. The distribution guide may protrude to be inclined toward a central portion of the first guide surface. The distribution guide may extend from an end of the first guide surface to an inner surface of the rear panel. A protruding height of the distribution guide may increase in a direction to an end of the first guide surface.

The distribution guide may be provided as a plurality of distribution guides spaced apart from each other in a direction of a rotary shaft of the cross-flow fan, and intervals of the plurality of distribution guides may decrease in a direction away from the center of the first guide surface. When the distribution guide is depressed from the first guide surface, a depression depth of the distribution guide may increase in a direction toward an end of the first guide surface. When the distribution guide is provided as a plurality of distribution guides depressed from the first guide surface, intervals between the distribution guides may increase in a direction away from a center of the first guide surface increases.

A distance from the second guide surface to a blade of the cross-flow fan may increase as a distance from the end of the first guide surface increases.

The details of other embodiments are included in the detailed description and drawings.

Advantageous Effects

According to an air conditioner according to embodiments disclosed herein, there are one or more of the following effects.

First, as air is uniformly distributed by distribution guides and suctioned into a cross-flow fan, it is possible to suppress the occurrence of a vortex, thereby reducing noise.

Second, as air to be suctioned into the cross-flow fan is concentrated to a center by adjusting intervals of distribution guiders, it is possible to minimize flow loss caused due to friction with a wall surface of a case.

Third, by simplifying structural modifications for solving the above, it is possible to improve noise reduction performance without a significant difference from an existing manufacturing costs.

The effects are not limited to the above-described effects, and other unmentioned effects will be clearly understood to those skilled in the art from the description of claims.

DETAILED DESCRIPTION

Figure 1:
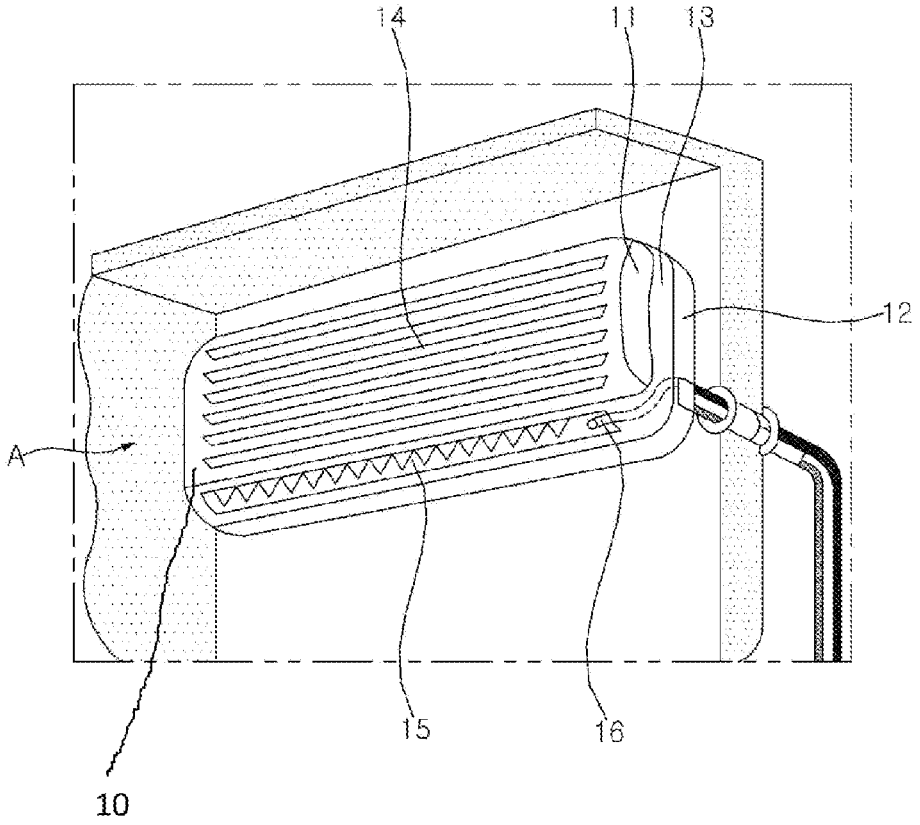
FIG. 1 is a perspective view of an air conditioner according to an embodiment.

Advantages and features and a method of achieving the same should become clear with embodiments described in detail below with reference to the accompanying drawings. However, the embodiments are not limited to the embodiments disclosed below and may be realized in various other forms, the embodiments make the disclosure complete and are provided to completely inform one of ordinary skill in the art to which the embodiments pertain of the scope of the disclosure, and the embodiments are defined only by the scope of the claims. Like reference numerals refer to like elements throughout the specification.

Hereinafter, embodiments will be described with reference to the drawings for explaining an air conditioner according to embodiments.

Figure 2:
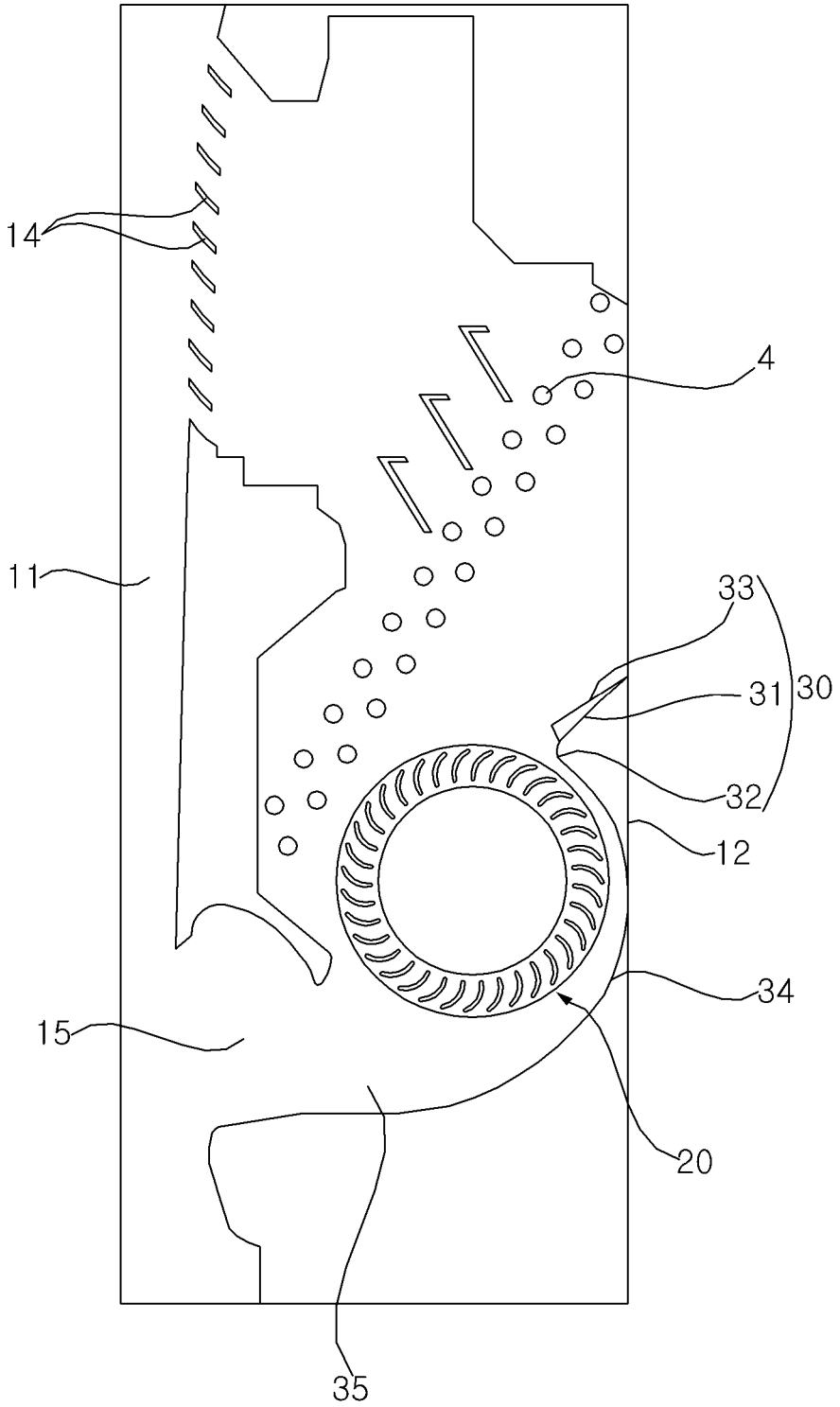
FIG. 2 schematically shows an internal structure of an air conditioner according to an embodiment.

Referring to FIGS. 1 and 2, an external appearance and an internal structure of an indoor unit A of an air conditioner may be schematically seen. The indoor unit A of the air conditioner may be attached to an upper side of an indoor wall, and may cool indoor air suctioned through an intake grille 14 and discharges the air downward through an outlet 15.

A case 10 forming an exterior of the indoor unit A may include a front panel 11, a rear panel 12, and a housing 13, and a rear surface of the rear panel 12 may be attached to a wall surface. In the arrangement of the components of the case 10, the rear panel 12, the housing 13, and the front panel 11 may be sequentially positioned from the wall surface, and the components may be connected to one another.

The intake grille 14 may be formed in a front surface of the front panel 11. A plurality of intake grilles 14 may be formed in the form of slits, and a plurality of slits may be spaced apart from each other in a vertical direction.

The intake grille 14 may function as an inlet through which indoor air is suctioned, and the air suctioned into the case 10 through the intake grille 14 may be cooled through a heat exchange process with a refrigerant, and then discharged indoors through the outlet 15. In this case, a refrigerant pipe 16 that supplies the refrigerant into the case 10 may be inserted into the case 10 and connected to a heat exchanger 4.

The outlet 15 may be formed in the front surface of the front panel 11 or in a lower portion of the housing 13, and may have a slit shape and be formed below the intake grille 14.

Referring to the internal structure of the case 10 with reference to FIG. 2, the heat exchanger 4 may be obliquely disposed on or at a downstream side of the intake grille 14. A cross-flow fan 20 may be disposed on or at a downstream side of the heat exchanger 4, and a stabilizer 35 disposed on or at a downstream side of the cross-flow fan 20 may guide the air discharged from the cross-flow fan 20 toward the outlet 15.

The air guide 30 includes a first guide surface 31 extending from the rear panel 12 and inclined downward toward the cross-flow fan 20, and a second guide surface 32 inclined downward from an end of the first guide surface 31 toward the rear panel 12. In addition, the air guide 30 may be in a broad sense a concept including a rounded part or portion 34, which extends from an end portion of the second guide surface 32 to surround the cross-flow fan 20, and the stabilizer 35, which is disposed on a discharge side of the cross-flow fan 20 to guide air toward the outlet 15.

A distribution guide 33 that uniformly distribute air, which has been suctioned into the cross-flow fan 20, in a direction of the rotary shaft 21 may be formed in the first guide surface 31, and a specific shape and arrangement structure of the distribution guide 33 is will be described hereinafter.

Briefly describing an air flow path in the case 10, air introduced into the case 10 through the intake grille 14 may flow downward toward the heat exchanger 4, and the air which has been heat-exchanged in the heat exchanger 4, may flow downward to reach the air guide 30. The air that has reached the air guide 30 may flow in a direction toward the cross-flow fan 20 along the first guide surface 31 of the air guide 30, and in this process, the distribution guide 33 may uniformly distribute the air, which is flowing in the direction toward the cross-flow fan 20, in a direction toward a rotary shaft 21 of the cross-flow fan 20.

The air flowing along the first guide surface 31 may be suctioned into the cross-flow fan 20 along the second guide surface 32 by a suction force of the cross-flow fan 20, and some of the air may flow to an outside of the cross-flow fan 20 along the rounded part 34, which is formed on or at a downstream side of the surface 32, to reach the stabilizer 35. The air introduced into the cross-flow fan 20 and the air flowing through the rounded part 34 may be joined in the stabilizer 35 and discharged indoors through the outlet 15.

Figure 3:
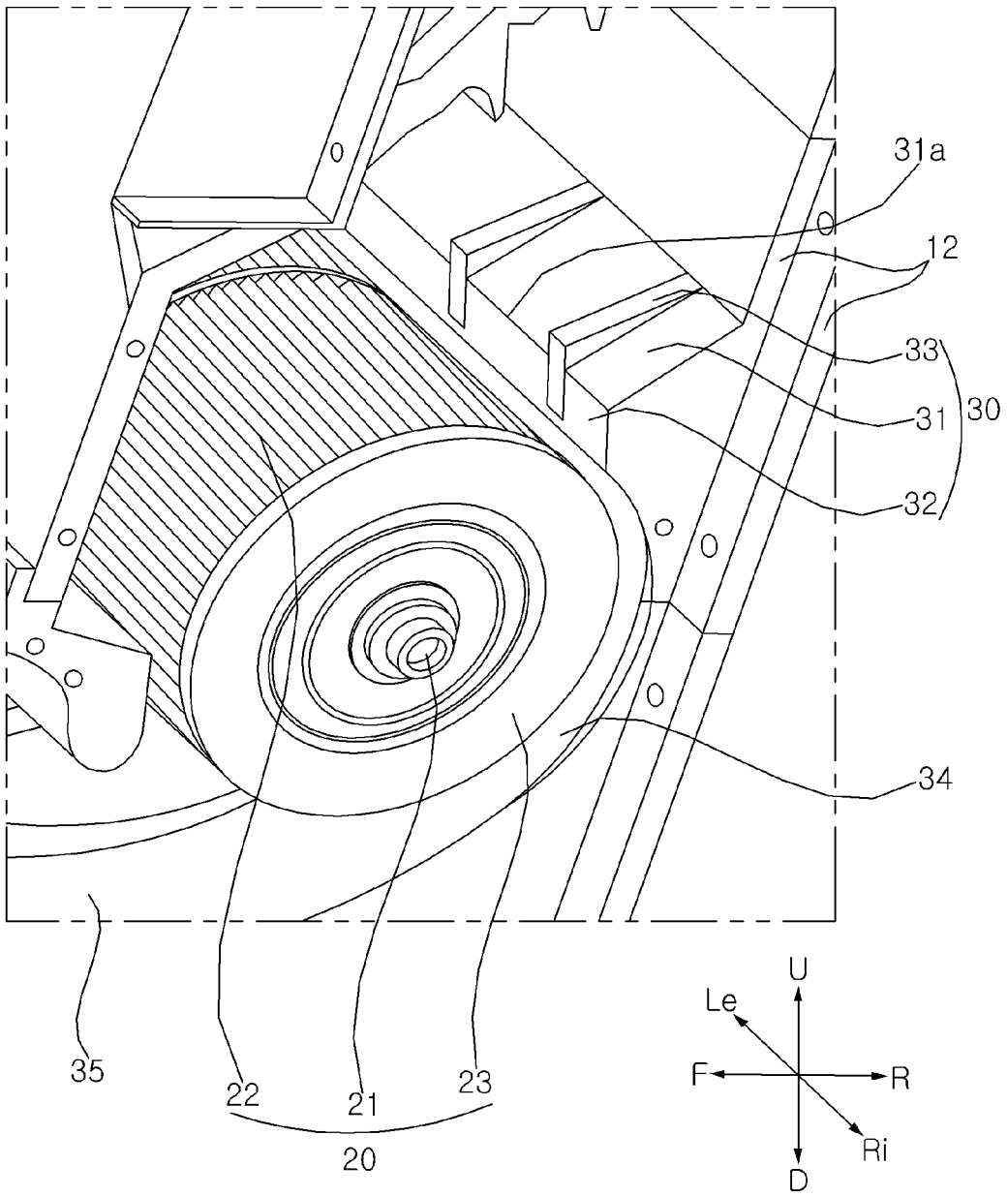
FIG. 3 shows an air guide and a cross-flow fan according to an embodiment.
Figure 4:
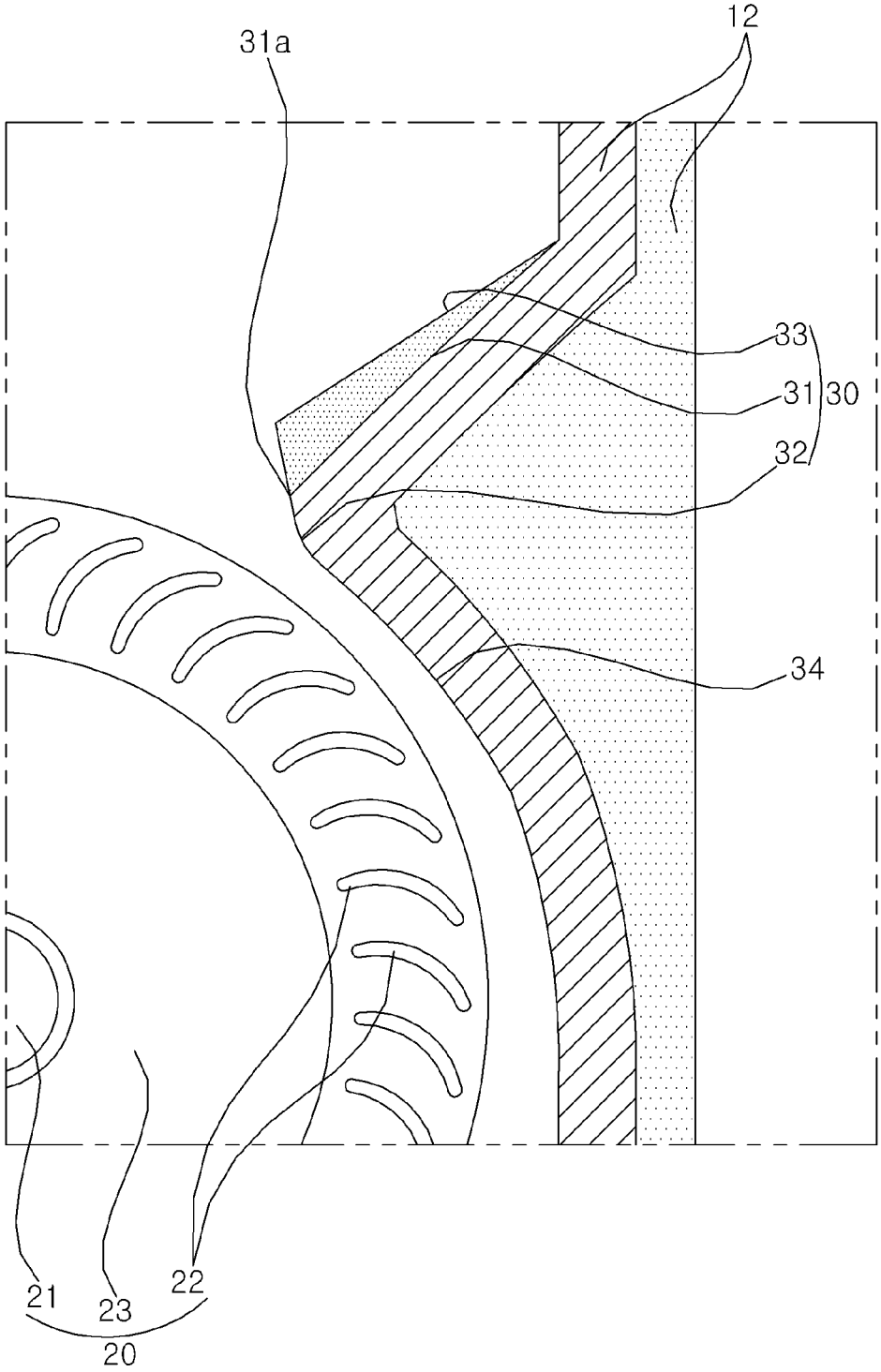
FIG. 4 schematically shows a right side view of FIG. 3.

Referring to FIGS. 3 and 4, arrangement structure and specific shapes of the air guide 30 and the cross-flow fan 20 may be visually seen.

In the structure of the cross-flow fan 20, the rotary shaft 21 may be disposed long in a left-right or lateral direction at a center of the cross-flow fan 20, and may be rotated by power from an external power source (not shown). A plurality of blades 22 may be disposed at positions spaced apart from the rotary shaft 21 by a predetermined distance, and the plurality of blades 22 may be disposed spaced apart from each other in a circumferential direction of the rotary shaft 21. Each blade 22 may be formed to extend lengthwise in the left-right direction in parallel with the rotary shaft 21, and may be connected to the rotary shaft 21 by a connector 23 so as to be rotated together with the rotary shaft 21.

The air guide 30 formed to extend from the rear panel 12 is disposed on an upper side from the cross-flow fan 20. The air guide 30 may be formed to extend lengthwise in the left-right direction in parallel with the rotary shaft 21, and may be formed to be in parallel with the rotary shaft 21.

The air guide 30 includes a first guide surface 31 inclined from the rear panel 12 toward the cross-flow fan 20, a second guide surface 32 inclined from an end of the first guide surface 31 toward the rear panel 12, and a plurality of distribution guides 33 formed in the first guide surface 31. Both ends of the first guide surface 31 and the second guide surface 32 may be formed to be in parallel with the rotary shaft 21, and one end of the second guide surface 32 may be connected to the rounded part 34.

The plurality of distribution guides 33 may be spaced apart from each other in a direction of the rotary shaft 21, and each distribution guide 33 may have one (first) end in contact with the rear panel 12 and the other (second) end formed to protrude from the first guide surface 31 so as to be in contact with an edge 31*a*.

One side of the distribution guide 33 may be in contact with edge 31*a* to form a continuous surface with the second guide surface 32. As a result, it is possible to suppress occurrence of a vortex due to a sudden flow path change at the edge 31*a*.

A protruding height of the distribution guide 33 may vary along the first guide surface 31, and may have a greater value toward the edge 31*a*. The height of the distribution guide 33 may have a greatest value at the edge 31*a*, and may constantly decrease toward the rear panel 12.

When the air reaching the air guide 30 through the heat exchanger 4 flows in a direction toward the cross-flow fan 20 along the first guide surface 31, the air may flow along the first guide formed between the plurality of distribution guides 33, and a flow rate may be determined in proportion to an area of the first guide surface 31 formed between the plurality of distribution guides 33. The plurality of distribution guides 33 may uniformly distribute the air flowing along the first guide surface 31 by the above-described principle.

An inclination angle of the second guide surface 32 inclined toward the rear panel 12 from the edge 31*a* may be constant. The inclination angle may be formed so that a distance from the blade 22 increases as a distance from the edge 31*a* increases, and the second guide surface 32 as a whole may have the shape of a nozzle surface. Accordingly, air reaching the edge 31*a* may be accelerated while flowing along the second guide surface 32 so that the air is suctioned into the cross-flow fan 20.

Figure 5:
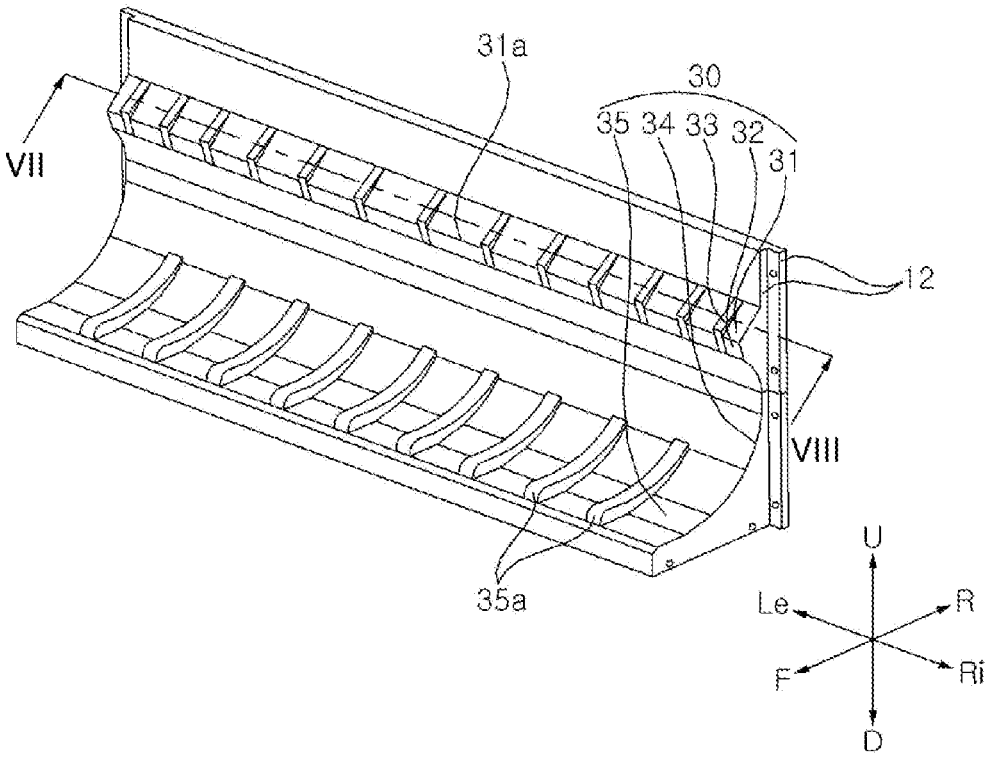
FIG. 5 is a perspective view of an air guide according to an embodiment.
Figure 6:
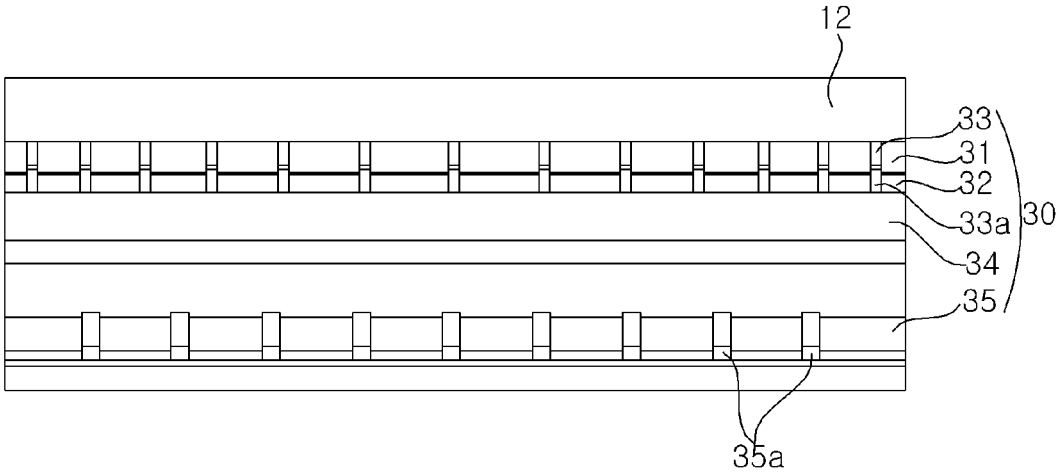
FIG. 6 is a front view of FIG. 5.

Referring to FIGS. 5 and 6, the overall shape of the air guide 30 may be seen. The air guide 30 may be in a narrow sense a concept including only the first guide surface 31, the second guide surface 32, and the distribution guide 33, but may be in a broad sense a concept including the rounded part 34 and the stabilizer 35 in addition to the aforementioned components.

The structure of the distribution guide 33 protruding from the first guide surface 31 may be equally applied to the stabilizer 35 in the form of projections 35*a*. The distribution of the projections 35*a* formed in the stabilizer 35 may be symmetrical with the distribution guide 33 or may have an independent distribution.

An interval between any two of the plurality of distribution guides 33 spaced apart in the direction of the rotary shaft 21 may be smaller in a direction away from the center of the air guide 30. Accordingly, an interval between distribution guides 33 formed in the center of the air guide 30 may be wider than an interval between distribution guides 33 formed farthest in the left-right direction of the air guide 30. The arrangement of intervals as described above causes the flow rate to be concentrated to the center of the cross-flow fan 20, thereby suppressing the occurrence of a vortex due to friction with a wall surface of the case 10.

Figure 7:
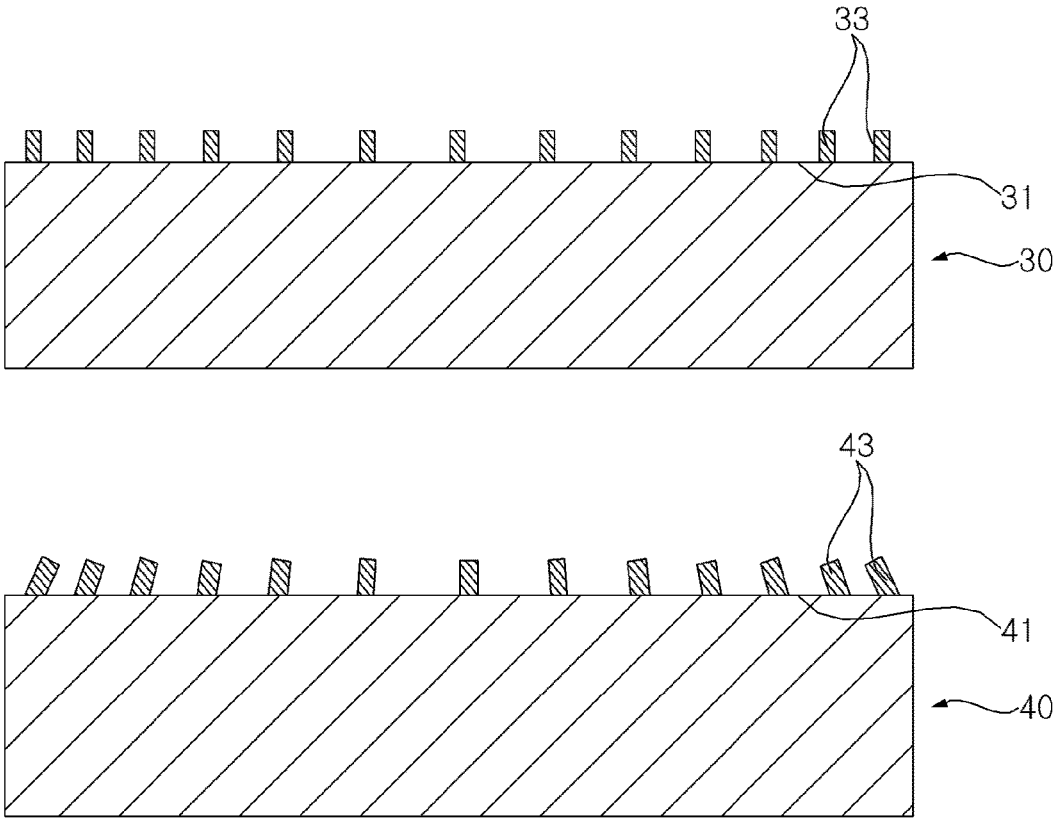
FIG. 7 is a cross-sectional view, taken along line VII-VII' shown in FIG. 5 according to the embodiment of FIG. 3 and the embodiment of FIG. 5.

Referring to FIG. 7, a cross section VII-VII' shown in FIG. 5 may be seen according to two embodiments.

Hereinafter, a cross-sectional view shown on an upper side of FIG. 7 is referred to as a first embodiment, and a cross-sectional view shown on a lower side of FIG. 7 is referred to as a second embodiment.

Distribution guides 33 formed according to the first embodiment may protrude vertically from first guide surface 31, and may have a rectangular cross-section. Intervals between the distribution guides 33 may be narrower in a direction away from a center of an air guide 30.

Distribution guiders 43 formed according to the second embodiment may protrude from first guide surface 41 while being inclined, and an inclination angle of each distribution guide 43 may be different from each other depending on a position where a corresponding distribution guide 43 is formed. The distribution guides 43 may protrude to be inclined toward a center of the first guide surface 41, and inclination angles of the distribution guides 43 may increase in a direction away from the center of the first guide surface 41. The intervals between the distribution guides 43 may be narrower in a direction away from the center of the first guide surface 41. Accordingly, a flow rate of air flowing between the plurality of distribution guides 43 may be more concentrated to a center of a cross-flow fan.

Figure 8:
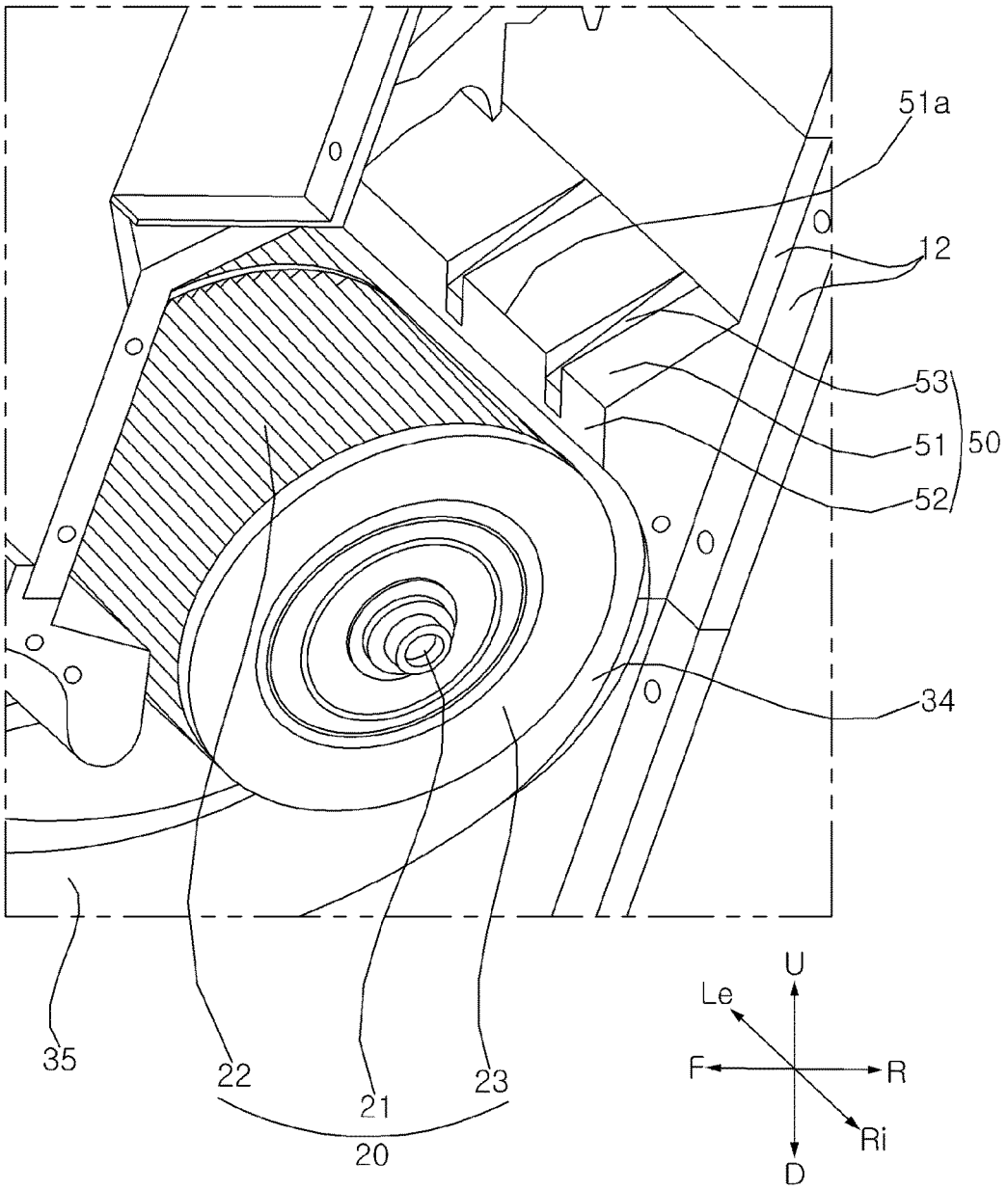
FIG. 8 shows an air guide and a cross-flow fan according to another embodiment.

Referring to FIG. 8, an arrangement structure and shape of air guide 50 and the cross-flow fan 20 according to another embodiment may be seen. According to this embodiment, distribution guides 53 formed in first guide surface 51 may be depressed from the first guide surface 51.

Depression depths of the distribution guides 53 may increase in a direction toward edge 51*a*, and may gradually decrease in a direction away from the edge 51*a*.

The distribution guides 53 may be depressed from a boundary point between the first guide surface 51 and rear panel 12 to the edge 51*a*, and may be vertically depressed from the first guide surface 51. The plurality of distribution guides 53 may be spaced apart from each other in a direction of the rotary shaft 21, and intervals between the plurality of distribution guides 53 may increase in a direction away from a center of the first guide surface 51. Accordingly, an interval between distribution guides 53 formed in the center of the first guide surface 51 may be narrower than an interval between distribution guides 53 formed farthest in a left-right or lateral direction of the first guide surface 51.

In this embodiment, when air reaching air guide 50 through heat exchanger 4 flows in a direction toward the cross-flow fan 20 along the first guide surface 51, the air may flow through depressed spaces of the plurality of distribution guides 53, and a flow amount of the air may be determined in proportion to a size the recessed spaces of the distribution guides 53.

According to the above-described principle, the structure of the distribution guides 53 according to this embodiment as described above causes a flow rate of air to be concentrated to the center of cross-flow fan 20, thereby suppressing the occurrence of a vortex due to friction with a wall surface of a case 10.

The structure of the cross-flow fan 20 or the air guide 50 other than the above-described structure of the distribution guide 53 is the same as or similar to that of the previous embodiment, and thus, description thereof has been omitted.

Figure 9:
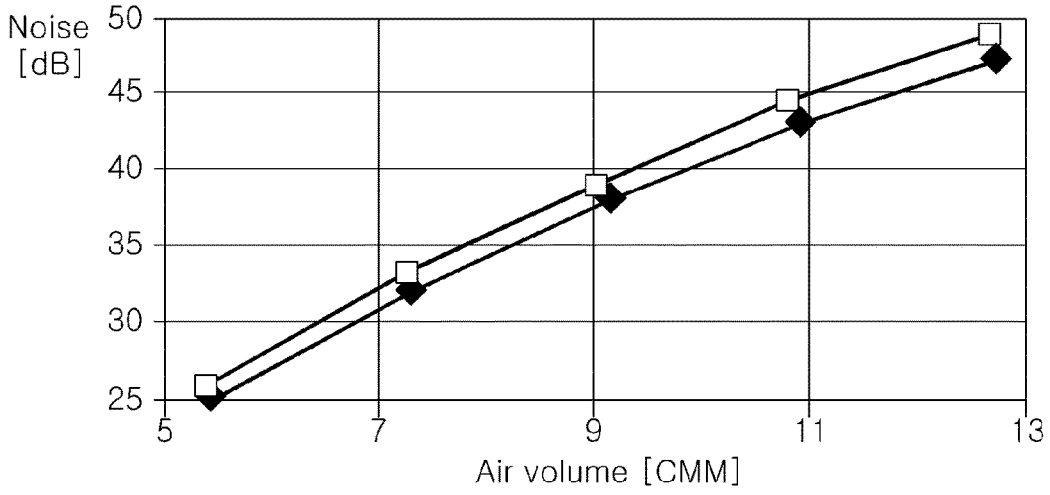
FIG. 9 is a graph showing a noise reduction effect of a cross-flow fan according to an embodiment.

Referring to FIG. 9, a noise reduction effect of an air conditioner according to an embodiment may be seen in a graph.

The X-axis in the graph represents an air volume suctioned into a cross-flow fan 20, and the Y-axis in the graph represents noise intensity with respect to a corresponding air volume. A line connecting rhombus dots in the graph is a line showing a noise level according to an embodiment, and a line connecting square dots is a line showing a noise level according to a related art. In an entire air volume region on the graph, the noise level according to the embodiment was measured to be lower than that of the related art, and thus, it may be found that there is a noise reduction effect.

Figure 10:
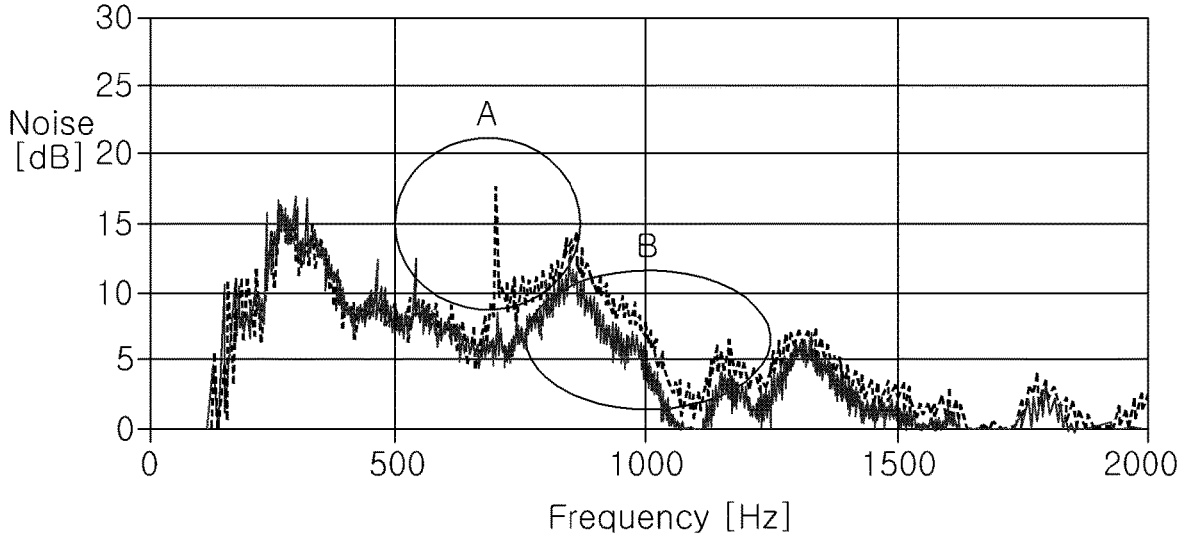
FIG. 10 is another graph showing a noise reduction effect of a cross-flow fan according to an embodiment.

Referring to FIG. 10, a noise reduction effect of an air conditioner according to an embodiment may be seen with noise spectrum analysis. The X-axis in a graph represents a frequency range of noise generated by the air conditioner, and the Y-axis represents intensity of noise in the corresponding frequency range.

A solid line on the graph indicates a noise level according to an embodiment, and a dotted line indicates a noise level according to a related art. It may be seen that noise is reduced by about 10 dB compared to the related art in section A on the graph and that noise is reduced by about 3 dB compared to the related art in section B (700 to 1200 Hz), indicating that there is a noise reduction effect compared to the related art.

While embodiments have been illustrated and described above, the embodiments are not limited to the aforementioned specific embodiments, various modifications may be made by a person with ordinary skill in the technical field to which the embodiments pertain without departing from the subject matters that are claimed in the claims, and these modifications should not be appreciated individually from the technical spirit or prospect.

The invention claimed is:

1. An air conditioner, comprising:

a case comprising a front panel and a rear panel, wherein an intake grille and an outlet are formed on the front panel, and wherein external air is introduced through the intake grille, and the introduced air is discharged through the outlet;

a cross-flow fan disposed in the case, wherein the cross-flow fan suctions air into the case; and a heat exchanger that heat-exchanges the introduced air with refrigerant, wherein an air guide located at a downstream side of the heat exchanger to guide the introduced air to the cross-flow fan is formed on the rear panel, wherein the air guide comprises a first guide surface inclined forward toward the cross-flow fan, and a second guide surface located at a downstream side of the first guide surface and inclined rearward, wherein a plurality of distribution guides that distributes and guides air is formed in the first guide surface, and wherein the plurality of distribution guides protrudes from the first guide surface, wherein the plurality of distribution guides is spaced apart in a direction of a rotational axis of the cross-flow fan, and wherein intervals of the plurality of distribution guides decrease in a direction away from a center of the first guide surface.

2. The air conditioner of claim 1, wherein the plurality of distribution guides vertically protrudes from the first guide surface.

3. The air conditioner of claim 1, wherein the plurality of distribution guides is inclined toward a center of the first guide surface.

4. The air conditioner of claim 3, wherein the plurality of distribution guides is spaced apart in a direction of a rotational axis of the cross-flow fan, and wherein angles of inclination of the plurality of distribution guides relative to a central portion of the first guide surface increases in a direction away from the central portion of the first guide surface.

5. The air conditioner of claim 1, wherein the plurality of distribution guides extend from an end of the first guide surface so as to be in contact with the rear panel.

6. The air conditioner of claim 5, wherein ends of the plurality of distribution guides form a continuous surface with the second guide surface.

7. The air conditioner of claim 1, wherein a protruding height of the plurality of distribution guides increases in a direction toward an end of the first guide surface.

8. The air conditioner of claim 1, wherein the cross-flow fan comprises:

a rotary shaft; and a plurality of blades spaced apart from each other in a circumferential direction of the rotary shaft and connected to the rotary shaft by a connector, and wherein a distance of the second guide surface from ends of the plurality of blades increases as a distance thereof from an end of the first guide surface increases.

* * * * *